US006262691B1

(12) United States Patent
Austin et al.

(10) Patent No.: US 6,262,691 B1
(45) Date of Patent: Jul. 17, 2001

(54) ANTENNA MOUNTING ASSEMBLY WITH INSTALLATION TOOL

(75) Inventors: Neal D. Austin, San Jose; Raymond R. Blasing, Los Altos; David P. Fries, Campbell, all of CA (US)

(73) Assignee: Endgate Corporation, Sunnyvale, CA (US)

( * ) Notice: Subject to any disclaimer, the term of this patent is extended or adjusted under 35 U.S.C. 154(b) by 0 days.

(21) Appl. No.: 09/398,831

(22) Filed: Sep. 16, 1999

(51) Int. Cl.[7] ..... H01Q 1/12
(52) U.S. Cl. ..... 343/890; 343/878; 343/892
(58) Field of Search ..... 343/878, 881, 343/882, 890, 892, 874

(56) References Cited

U.S. PATENT DOCUMENTS

| | | | | |
|---|---|---|---|---|
| D. 361,068 | | 8/1995 | Brehmer et al. . | |
| 4,109,251 | | 8/1978 | MacDougall . | |
| 4,654,612 | | 3/1987 | Smith . | |
| 4,755,830 | | 7/1988 | Plunk . | |
| 4,799,672 | | 1/1989 | Wright . | |
| 5,077,561 | * | 12/1991 | Gorton et al. | 343/882 |
| 5,291,211 | | 3/1994 | Tropper . | |
| 5,355,145 | * | 10/1994 | Lucas | 343/882 |
| 5,402,139 | | 3/1995 | Maeshima . | |
| 5,453,756 | | 9/1995 | Lowrey . | |
| 5,467,955 | | 11/1995 | Beyersmith . | |
| 5,867,132 | | 2/1999 | Blasing et al. . | |
| 5,929,817 | * | 7/1999 | Clark | 343/882 |
| 6,031,508 | * | 2/2000 | Ishizuka et al. | 343/882 |

* cited by examiner

*Primary Examiner*—Tan Ho
(74) *Attorney, Agent, or Firm*—Ingrid M. McTaggart; Edward B. Anderson

(57) ABSTRACT

An antenna support structure has a base for mounting on a pole clamp. The position of the pole clamp on a pole is adjusted by use of a removable installation tool. The installation tool comprises front and back tool clamp plates that are frictionally secured about the pole by fasteners. One or more adjustment tools may be mounted on the tool clamp plates and interact with the pole clamp and the antenna support structure so as to effect movement of the pole clamp and the antenna relative to the installation tool and the pole. Movement of the pole clamp and the antenna relative to the pole allows an operator to finely tune the azimuth and/or elevation angles of the antenna which is mounted on the pole clamp.

19 Claims, 8 Drawing Sheets

ANTENNA MOUNTING ASSEMBLY WITH INSTALLATION TOOL

TECHNICAL FIELD

The present invention relates to assemblies for mounting antennas to poles, and more particularly, to assemblies for mounting antennas to poles wherein the assemblies each include a removable installation tool.

DESCRIPTION OF RELATED ART

The present invention is particularly intended for use on directional antennas, although it may be used on omnidirectional or sectoral antennas as well. A directional antenna is an antenna with a signal strength that is sensitive to its angular orientation. The angular orientation is commonly measured in terms of azimuth (i.e., horizontal angle) in combination with an elevation (i.e., vertical) angle. An assembly for mounting such an antenna is preferably provided with a bracket that includes a clamp for mounting to a pole and a support structure for supporting the antenna relative to the clamp. The bracket may also have components for adjusting each of the azimuth and the elevation angle so that the signal of the antenna can be maximized. The support structure for the antenna typically is attached to the clamp, and the elevation angle of the support structure and antenna are adjusted with respect to the clamp.

Adjustment of the azimuth is obtained in some conventional mounting assemblies by properly orienting the bracket around the vertical pole. In other words, a separate component may not be provided for adjusting the azimuth. The bracket illustrated in U.S. Pat. No. Des. 361,068, for example, provides only an elevation angle adjustment mechanism.

The adjustability of the orientation of the clamp around the pole may not provide a high enough resolution in azimuth, especially for highly directional antennas that permit only a small error in angular orientation. To be installed, the assembly must be lifted up to the desired point on the pole and then rotated horizontally around the pole until the antenna is aligned with a target. This procedure determines the exact orientation for clamping, which orientation must be maintained while attaching the clamp to the pole.

Given such difficulties, many bracket assemblies are provided with an additional component for azimuth adjustment. For example, the assembly illustrated in U.S. Pat. No. 5,867,132 provides a pole clamp that includes a pair of guide elements which define an arcuate path extending circumferentially around at least a portion of the pole clamp. The assembly further comprises an adjustment screw mounted on the pole clamp that is used to adjust the position of the antenna support structure along the arcuate path. Once the correct azimuth angle is achieved, locking screws secure the antenna support in position relative to the pole clamp. Such a conventional bracket assembly provides for fine adjustment of the antenna relative to the pole.

The assembly, however, has several disadvantages. The assembly comprises numerous parts and requires numerous tightening operations. The adjustment mechanisms, which are the more expensive components of the system, remain permanently attached to the pole after installation. Accordingly, these expensive components must be provided in each individual mounting assembly. Moreover, the permanently mounted adjustment mechanisms are exposed to environmental conditions such that the mechanisms may degrade several years after initial installation of the antenna.

Some of these disadvantages are overcome by using an installation tool that mounts to a pole below the antenna mounting assembly. Such a device, known to be produced by Andrew Corporation of Orland Park, Ill., provides adjustment of the azimuth by pushing the end of a threaded bolt against the assembly. These devices do not allow adjustment of the assembly in an opposite direction by pulling of the assembly toward an adjustment tool. Rather, two adjustment bolts are required to provide adjustment in opposite directions.

SUMMARY OF THE INVENTION

The present invention provides an antenna mounting assembly that overcomes disadvantages of the prior art. One aspect of the present invention provides a simplified mounting assembly comprised of few parts. Another aspect of the present invention provides an installation tool that allows adjustment of a pole clamp and removal of the installation tool from the permanent mounting once adjustment of the pole clamp is accomplished. Another aspect provides a single adjustment tool that allows adjustment of both the elevation and azimuth angle of an antenna. The invention also provides two-directional adjustment of the antenna away from and toward an adjustment tool.

These features are provided generally in a mounting assembly having an antenna support structure connected to a pole clamp in a manner preferably allowing movement of the support structure relative to the pole clamp. An installation tool is mounted on the pole wherein the pole clamp and the support structure are movable relative to the installation tool during the installation process. Accordingly, the assembly provides a simple, low cost method for attachment of an antenna to a support structure and a pole clamp and aligning of the antenna during installation.

More specifically, in the preferred embodiment, the assembly comprises a simple permanent portion and a separate, removable installer's tool. The permanent portion attaches the antenna to the pole and is left on the pole after alignment. The installer's tool interacts with the permanent portion of the assembly during installation in order to correctly secure the position of the antenna, and contains the more expensive mechanisms that are required for alignment of the antenna. These expensive mechanisms are taken with the installer after alignment is complete, thereby minimizing the cost of materials left on the pole.

The assembly provides two degrees of freedom for aligning the antenna during installation. Initial azimuth adjustments are made by rotating the antenna support structure and the pole clamps together about the mounting pole. The pole clamps are then loosely secured to the pole to secure the pole clamps in this initial position. Initial elevation adjustments are made by rotating the antenna support structure with respect to an elevation plate of one of the pole clamps. A shear pin feature is incorporated into the elevation plate of the pole clamp to provide a fixed pivot point during elevation adjustments. The mounting foot of the antenna is free to rotate under four flange nuts that attach the antenna support structure to the elevation plate. When all initial adjustments to the elevation angle have been made, the flange nuts can be loosely secured to provide a somewhat rigid connection between the antenna support structure and the mounting pole clamp.

Fine adjustments to azimuth and elevation are made by use of two adjuster mechanisms. In the case of azimuth adjustments, a collar on the installer's tool remains fixedly secured to the pole while an adjustment bolt of the collar is manipulated. The adjustment bolt interacts with the pole clamps to force the pole clamps and the antenna to rotate in either a forward or a rearward direction about the pole by movement of the adjustment bolt. Once the correct azimuth angle is achieved, the pole clamps are secured in place. For elevation adjustments, the antenna support structure is forced to rotate in either a forward or a rearward direction about the shear pin in the elevation plate by movement of an adjustment bolt in the elevation adjuster mechanism on the installation tool. The flange nuts on the elevation plate are then tightened once the elevation adjustment has been made. The installer's tool is then removed from the pole without fear of changing the antenna alignment.

It can be seen that such a mounting assembly has several beneficial features. The installation tool of the mounting assembly may be installed on the pole prior to installation of the pole clamps such that the pole clamps are supported by the installation tool during adjustment thereof The present invention includes fewer parts then previous mounting assemblies and requires fewer tightening operations. The installation tool facilitates adjustment of the pole clamps and the antenna in either a forward or a rearward direction. Moreover, the installation tool includes precision parts which are removed from the installation site after the pole clamps are installed thereby facilitating reuse of these precision parts and limiting deterioration of these parts due to harsh environmental conditions.

DETAILED DESCRIPTION OF THE PREFERRED EMBODIMENTS

As has been mentioned, the invention provides for an antenna mounting assembly for supporting a directional, sectoral or omni-directional antenna on a pole. The pole typically is vertical and of a round cross section, although neither is a requirement for practicing the invention, as will be apparent from the following description. The antenna shown has a disk shape but any size or shape antenna may be installed with the present mounting assembly.

Figure 1:
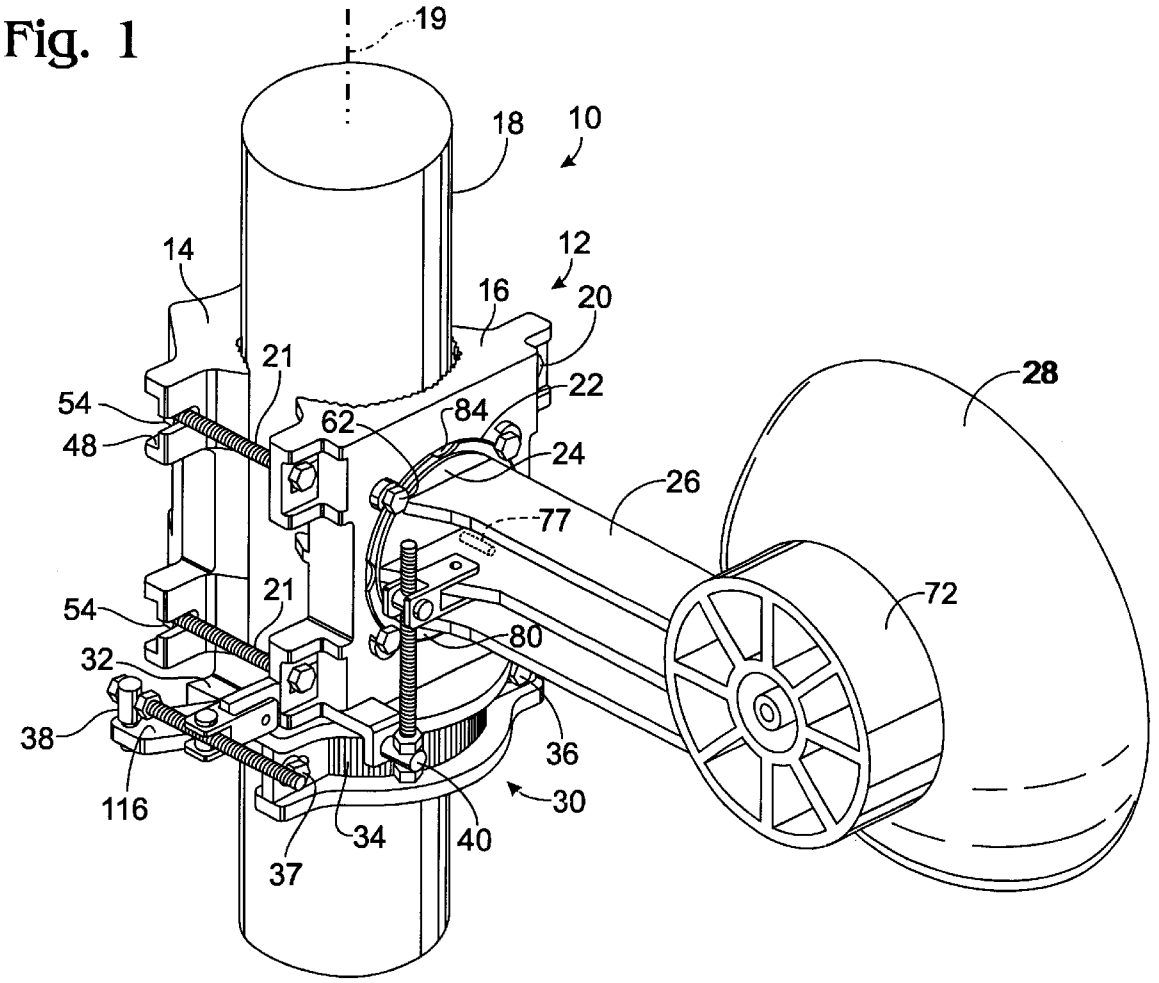
FIG. 1 is an isometric view of the antenna mounting assembly positioned on a pole with the installation tool in place.
Figure 2:
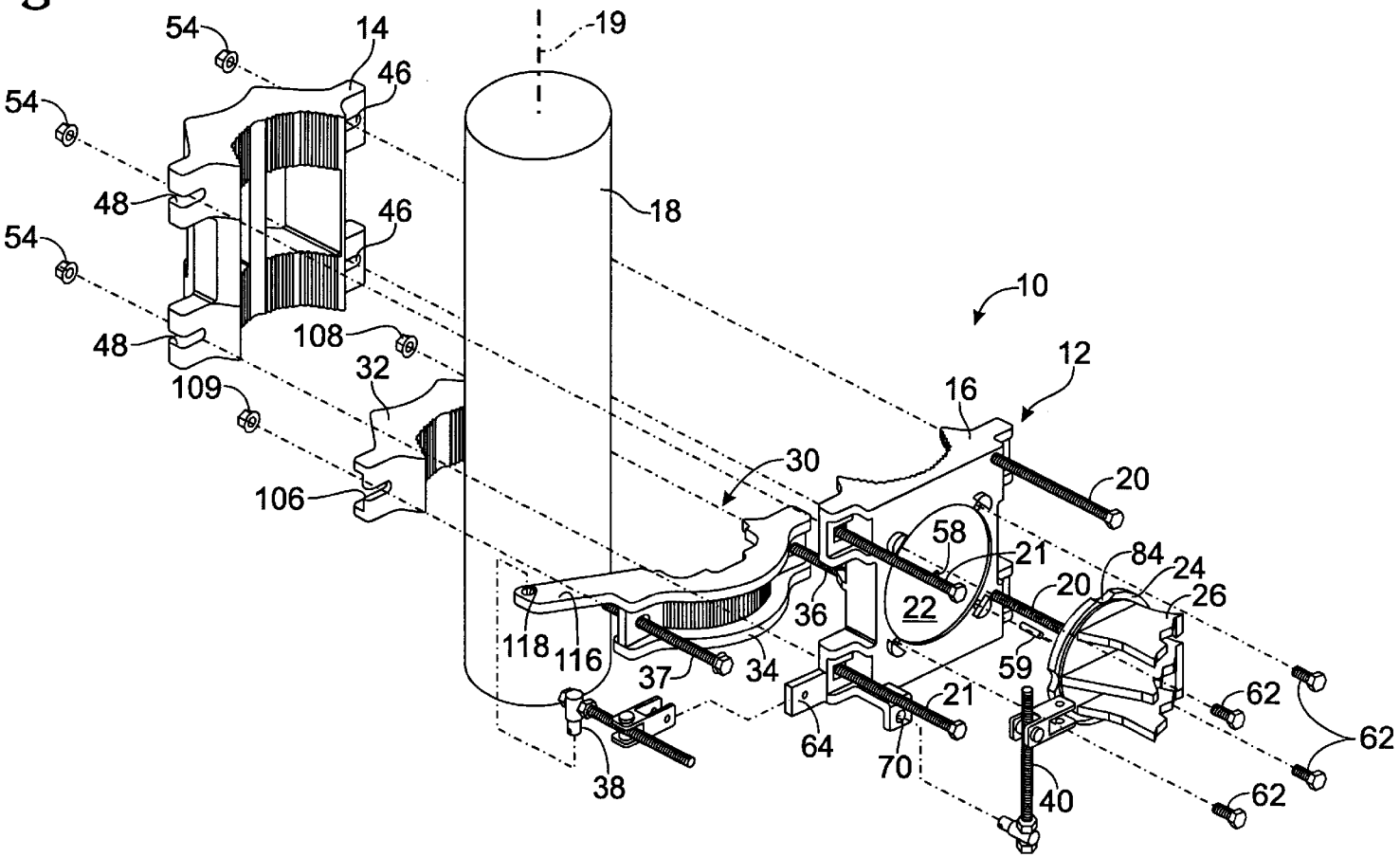
FIG. 2 is an exploded isometric view illustrating individual components of the antenna mounting assembly of FIG. 1.

FIGS. 1 and 2 show an antenna mounting assembly 10 made according to the invention. Assembly 10 comprises a pole clamp 12 including a back pole clamp plate 14 and a front pole clamp plate 16 secured opposite one another across a pole 18 by fasteners 20 and 21. Pole 18 typically has a circular cross section and an elongate axis 19 extending therethrough. Front pole clamp plate 16 includes an antenna interface plate 22, also called an elevation plate, adapted to receive thereon a base 24 of an antenna support structure 26. An antenna 28 typically is mounted on support structure 26 opposite base 24. Assembly 10 further comprises an installation tool 30 including a back tool clamp plate 32 and a front tool clamp plate 34 secured opposite one another across pole 18 by fasteners 36 and 37. A first adjustment tool 38 is mounted on front tool clamp plate 32 and interacts with the pole clamps to facilitate azimuth adjustment of the pole clamps on the pole into a desired position when pole 18 is in a vertical orientation. In the preferred embodiment, assembly 10 further comprises a second adjustment tool 40 mounted on front pole clamp plate 16, wherein the second adjustment tool interacts with antenna support structure 26 to facilitate elevation adjustment of the support structure on the front pole clamp plate into a desired position when pole 18 is in a vertical orientation. When pole 18 is in a horizontal orientation, adjustment tool 38 will adjust the elevation angle of an antenna and adjustment tool 40 will adjust the azimuth angle of the antenna.

Figure 3:
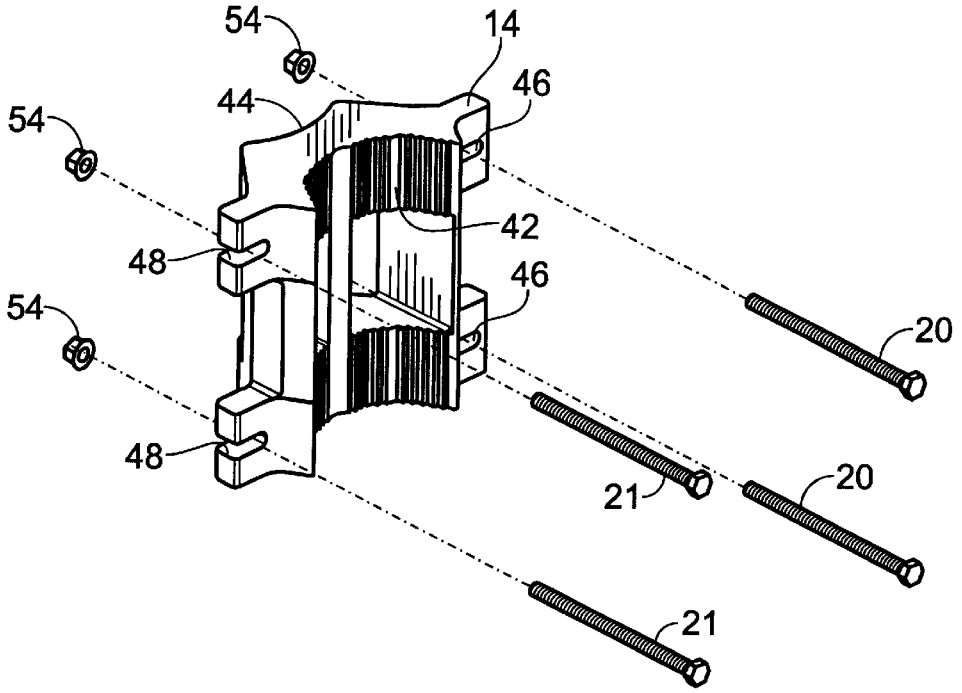
FIG. 3 is an isometric view of the back plate of the pole clamp.

FIGS. 3 through 10 show the individual components of the mounting assembly, which will now be described. FIG. 3 shows back pole clamp plate 14 which includes a first concave surface 42, also referred to as a jaw, having a shape that corresponds generally to an outer curvature of pole 18. Back pole clamp plate 14 may also comprise a second concave surface 44 sized to accommodate a smaller diameter pole when the orientation of the plate is reversed with respect to the pole. Back pole clamp plate 14 includes apertures 46 and slits 48 adapted to receive fasteners 20 and 21, respectively, therein. The simultaneous use of apertures and slits on the back plate facilitates factory assembly of back pole clamp plate 14 to front pole clamp plate 16.

Figure 4:
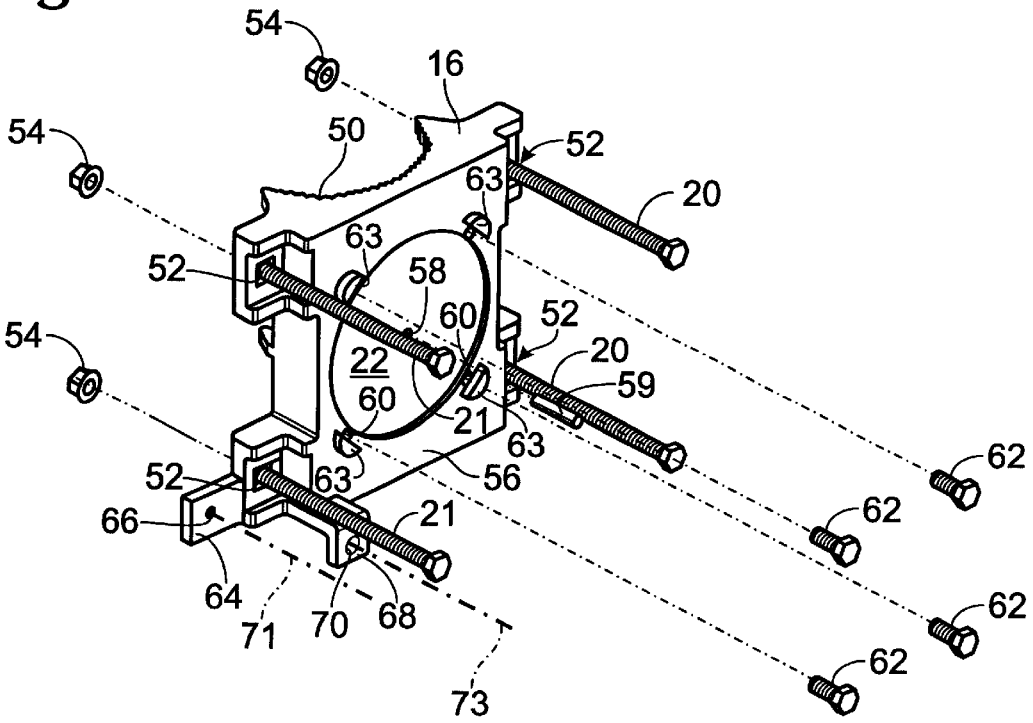
FIG. 4 is an isometric view of the front plate of the pole clamp showing the elevation plate.

FIG. 4 shows front pole clamp plate 16 including a concave surface 50, also referred to as a jaw, having a shape that corresponds generally to an outer curvature of pole 18. Front pole clamp plate 16 further comprises apertures 52 positioned in corresponding alignment with apertures 46 and slits 48 of the back pole clamp plate and being adapted to receive therein fasteners 20 and 21. Fasteners 20 and 21 typically are threaded screws that fit easily through apertures 46, slits 48 and apertures 52 and which are secured in place by locking nuts 54. To install the pole clamp on a pole, fasteners 21, which are secured within front pole clamp plate 16, are removed from slits 48 on back pole clamp plate 14, both sections of the pole clamp are positioned around a pole, and fasteners 21 are then repositioned within slits 48. Locking nuts 54 are then tightened on fasteners 20 and 21 to secure the tool clamp plates on the pole.

Still referring to FIG. 4, antenna interface plate 22, also called the elevation plate, comprises a flat, recessed circular surface centered on outwardly facing surface 56 of front pole clamp plate 16. The recessed nature of the elevation plate facilitates rotational movement within the interface plate of circular base 24 of the antenna support structure, as will be described below. Interface plate 22 further comprises an aperture 58 radially centered on the plate and adapted for receiving therein a shear pin 59 to further facilitate rotational movement of base 24 within the interface plate. Outwardly facing surface 56 typically includes four bolt receiving apertures 60 equally spaced around the interface plate and adapted for receiving therein bolts 62. Raised surfaces 63 are positioned radially outwardly of bolt receiving apertures 60 and act as stops for bolts 62 in the fastened position.

Front pole clamp plate 16 further includes a first outwardly extending flange 64 having an aperture 66 extending therethrough and a second outwardly extending mounting flange 68 having an aperture 70 extending therethrough. In the preferred orientation as shown, flange 64 extends horizontally outwardly from outwardly facing surface 56 such that an axis 71 of aperture 66 is aligned normal to the plane of surface 56. Mounting flange 68 extends vertically downwardly from outwardly facing surface 56 such that an axis 73 of aperture 70 is also aligned normal to the plane of surface 56.

Figure 5:
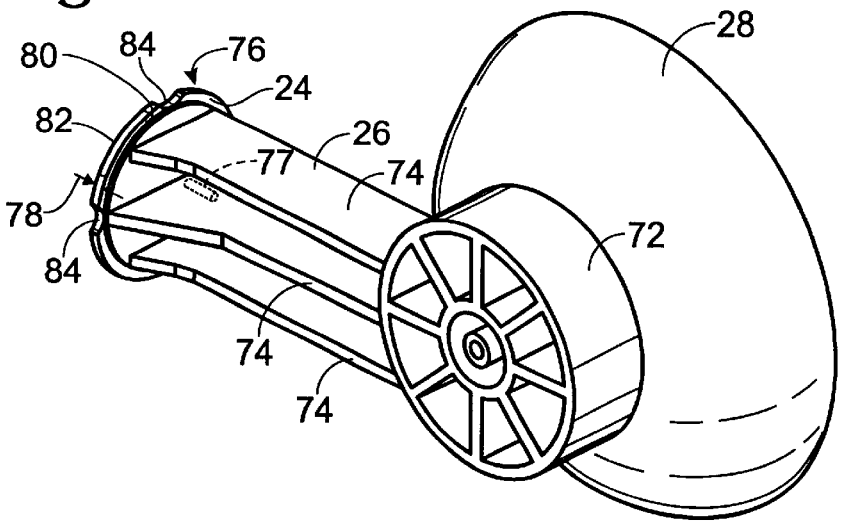
FIG. 5 is an isometric view of the antenna support structure with an antenna mounted thereon.

FIG. 5 shows antenna support structure 26 including base 24. Structure 26 includes an antenna receiving mounting surface 72 positioned opposite base 24 and at least one support brace 74 extending therebetween. As shown, the preferred embodiment has three parallel support braces. Base 24 comprises a flat, circular plate 76 sized so as to be received within recessed interface plate 22, shown in FIG. 4, and a cylindrical recessed region 77 positioned within the base and extending into the central one of support braces 74. Cylindrical recessed region 77 is positioned and sized so as to receive pin 59 therein when the base is positioned adjacent the interface plate. Base 24 has a thickness 78 such that when positioned within interface plate 22, an outer surface 80 of the base is aligned with the outer surface of raised surfaces 63, shown in FIG. 4. A circular edge 82 of plate 76 is interrupted by recessed cutout potions 84 spaced equally around edge 82 and corresponding to the spacing of bolt receiving apertures 60 on first pole clamp plate 16, shown in FIG. 4.

Figure 6:
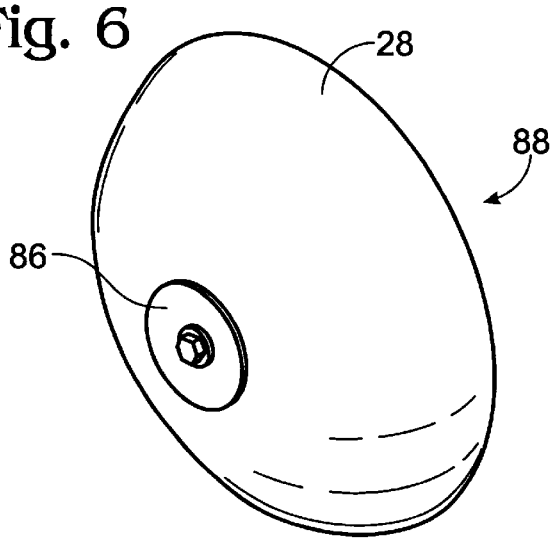
FIG. 6 is an isometric view of the rear of the antenna.

FIG. 6 shows a rear surface of the reflector of antenna 28 including a mounting surface 86 and a reception surface 88. The dimensions and shape of the antenna can be of any size and shape as known in the art. Support structure 26 and the reflector may also be made as a unitary component.

Figure 7:
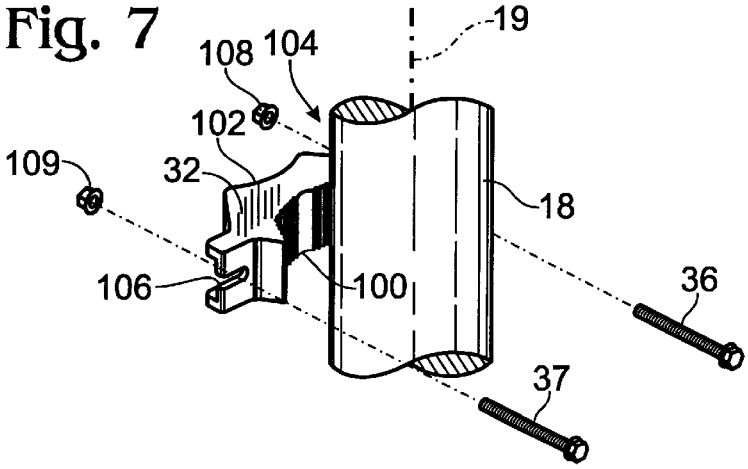
FIG. 7 is an isometric view of the back plate of the installation tool clamp positioned adjacent the pole.

FIG. 7 shows back tool clamp plate 32 which includes a first pole receiving surface 100, also referred to as a jaw, having a shape that corresponds generally to an outer curvature of pole 18. Back tool clamp plate 32 may also comprise a second pole receiving surface 102 sized to accommodate a smaller diameter pole when the orientation of the plate is reversed with respect to the pole. Back tool clamp plate 32 includes an aperture 104 (hidden from view) and a slit 106 adapted to receive fasteners 36 and 37 therein which are secured by locking nuts 108 and 109. The simultaneous use of an aperture and a slit on the back plate facilitates factory assembly of back tool clamp plate 32 to front tool clamp plate 34.

Figure 8:
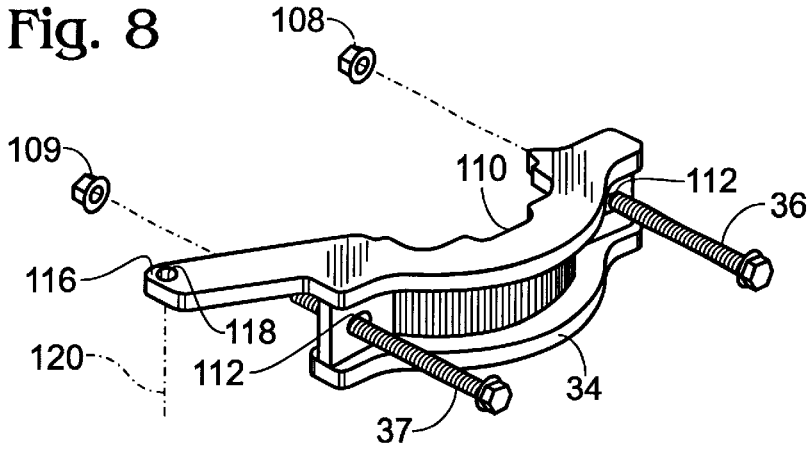
FIG. 8 is an isometric view of the front plate of the installation tool clamp.

FIG. 8 shows front tool clamp plate 34 including a pole receiving surface 110, also referred to as a jaw, having a shape that corresponds generally to an outer curvature of pole 18. Front tool clamp plate 34 further comprises apertures 112 positioned in corresponding alignment with aperture 104 and slit 106 of the back tool clamp plate and being adapted to receive therein fasteners 36 and 37. Fasteners 36 and 37 typically are threaded screws that fit easily through apertures 112, slit 106 and aperture 104 and which are secured in place by locking nuts 108 and 109. Front tool clamp plate 34 further includes an outwardly extending mounting flange 116 having an aperture 118 extending therethrough. In the orientation shown, mounting flange 116 is positioned horizontally outwardly of the remainder of the front tool clamp plate such that an axis 120 of aperture 118 is aligned with elongate axis 19 of pole 18 when the assembly is being installed. To install the tool clamp on a pole, fastener 37, which is secured within front tool clamp plate 34, is removed from slit 106 of back tool clamp plate 32, the tool clamp is positioned around the pole, and fastener 37 is then repositioned within the slit. Locking nuts 108 and 109 are then tightened on fasteners 36 and 37 to frictionally secure the clamp to the pole.

Figure 9:
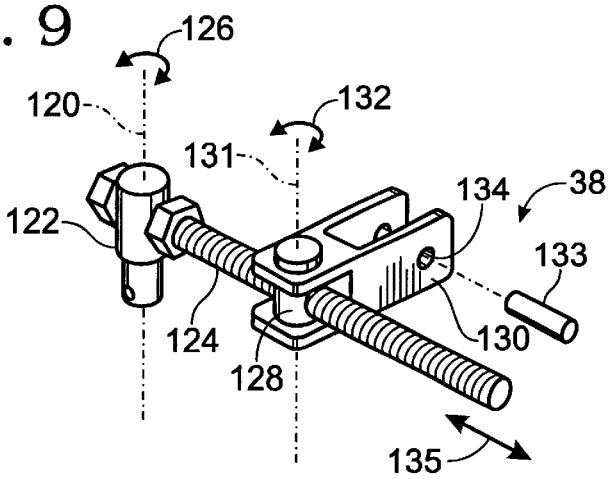
FIG. 9 is an isometric view of the first adjustment tool.

FIG. 9 shows first adjustment tool 38 comprising a through hole clevis 122 adapted to be pivotally mounted within aperture 118 of mounting flange 116 of front tool clamp plate 34. A threaded bolt 124 is positioned within clevis 122 such that bolt 124 pivots with clevis 122 about axis 120 in the directions indicated by arrow 126. A threaded clevis 128 is mounted on bolt 124 and includes a "C" shaped bracket 130 mounted thereon. Bracket 130 is pivotally mounted on clevis 128 such that the bracket pivots about an axis 131 of clevis 128 in the directions indicated by arrow 132. Bracket 130 includes apertures 134 extending therethough such that the bracket may be secured by a pin 133 that also passes through aperture 66 in outwardly extending flange 64, shown in FIG. 4, of front pole clamp plate 16. In such a secured position, bracket 130 is prevented from rotating with threaded bolt 124 as the bolt is turned such that rotation of the bolt will result in linear movement of bracket 130 and threaded clevis 128 along the length of the bolt in the directions indicated by arrow 135. In the orientation shown, first adjustment tool 38 acts to adjust the azimuth of the pole clamps with respect to the pole, as will be described below.

Figure 10:
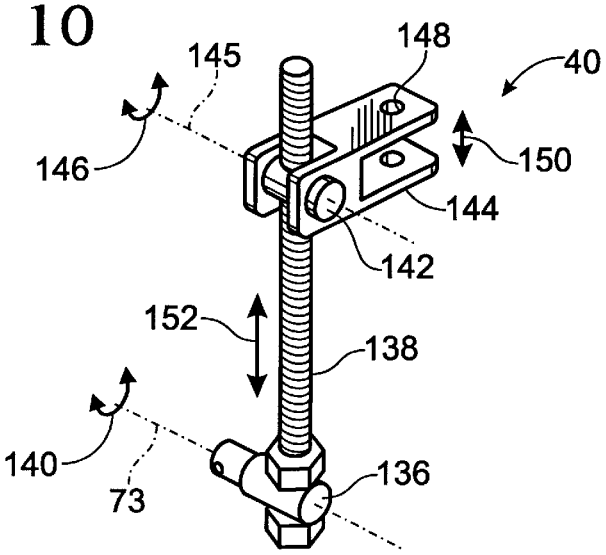
FIG. 10 is an isometric view of the second adjustment tool.

FIG. 10 shows second adjustment tool 40 comprising a through hole clevis 136 adapted to be pivotally mounted within aperture 70 of mounting flange 68 of front pole clamp plate 16, shown in FIG. 4. A threaded bolt 138 is positioned within clevis 136 such that bolt 138 pivots with clevis 138 about axis 73 in the directions indicated by arrow 140. A threaded clevis 142 is mounted on bolt 138 and includes a "C" shaped bracket 144 mounted thereon. Bracket 144 is pivotally mounted on clevis 142 such that the bracket pivots about an axis 145 of clevis 142 in the directions indicated by arrow 146. Bracket 144 includes apertures 148 extending therethough such that the bracket may be secured by a pin (not shown) to one of support braces 74 of antenna support structure 26. In the preferred embodiment, "C" shaped bracket 144 is manufactured in a size so as to be placed around the central one of support braces 74 wherein a width 150 of the central opening of "C" shaped bracket 144 is slightly larger then the thickness of the central one of support braces 74. In such a secured position, wherein bracket 144 frictionally engages and captures brace 74, the bracket is prevented from rotating with threaded bolt 138 as the bolt is turned such that rotation of the bolt will result in linear movement of bracket 144 and threaded clevis 142 along the length of the bolt in one of the directions indicated by arrow 152.

Referring again to FIGS. 1 and 2, installation and rough adjustment of the antenna mounting assembly will be described. Fastener 37 is removed from slit 106 in back tool clamp plate 32. Tool clamp plates 32 and 34 are then positioned around pole 18 and fastener 37 is repositioned within slit 106. Fasteners 36 and 37, which extend between back tool clamp plate 32 and front tool clamp plate 34, are tightened with locking nuts 108 and 109 so that the tool clamp plates are frictionally secured to pole 18. The tool clamp plates preferably are positioned on the pole just below the height at which the antenna will be mounted on the pole.

Fasteners 21 are removed from slits 48 in back pole clamp plate 14. Pole clamp plates 14 and 16 are then positioned around pole 18 and fasteners 21 are repositioned within slits 48. Fasteners 20 and 21, which extend between back pole clamp plate 14 and front pole clamp plate 16, are used to loosely secure the pole clamps to the pole by slightly tightening locking nuts 54. The pole clamp plates are then rotated around pole 18 to a position approximating the final desired azimuth angle of the antenna. Locking nuts 54 are then further tightened on fasteners 20 and 21 so that the pole clamp plates are frictionally secured to pole 18 in the desired orientation. During this process, the installation tool, comprising tool clamp plates 32 and 34, are used to support the unsecured pole clamp plates 14 and 16. Because the pole clamps are supported by the installation tool, the pole clamp plates are easily placed into a position on the pole at the height at which the antenna will be mounted on the pole. Accordingly, in a preferred installation method, the pole clamp plates are supported by the tool clamp plates prior to tightening of locking nuts 54 on fasteners 20 and 21 such that the tool clamp plates ease the installation of the pole clamps.

With the pole clamps frictionally secured to the pole, antenna 28 is secured to mounting surface 72 of antenna support structure 26. In the preferred mounting procedure, antenna 28 is secured to mounting surface 72 prior to securing the antenna support structure to the pole clamps. Base 24 of support structure 26 is then positioned adjacent antenna interface plate 22 such that cutout portions 84 are aligned with bolts 62 and such that pin 59 is received within recess 77 of base 24. In this orientation, the flat surface of plate 76 of base 24 is positioned directly adjacent interface plate 22 and pin 59 helps in the support of the heavy antenna structure held by the installer. Base 24 and support structure 26 are then rotated within the interface plate and about pin 59 such that cutout portions 84 become unaligned with bolts 62 and such that the heads of bolts 62 extend over surface 80 of the base. Base 24 is rotated to a position approximating the final desired elevation angle of the antenna. Bolts 62 are then slightly tightened to frictionally secure base 24 against antenna interface plate 22. The antenna is now in position to receive fine adjustment of the azimuth and elevation angles.

Figure 11:
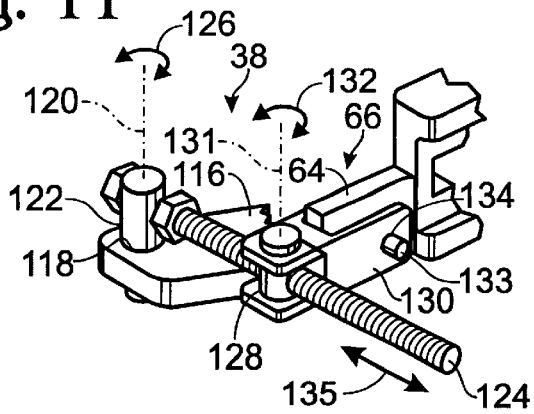
FIG. 11 is a detailed isometric view of the first adjustment tool secured to the front plate of the installation tool clamp.

FIG. 11 shows a detailed isometric view of first adjustment tool 38 secured to the front tool clamp plate of the installation tool. To finely adjust the azimuth angle of the antenna, throughhole clevis 122 is secured within aperture 118 of front tool clamp plate 34. This operation may be completed prior to mounting of the installation tool on pole 18. Threaded bolt 124 is rotated until "C" shaped bracket 130 is aligned with flange 64 of front pole clamp plate 16, whereupon pin 133 is secured within aligned apertures 66 and 134 to secure the bracket to front pole clamp plate 16. Fasteners 20 and 21 are then slightly loosened such that installation tool 30 supports the pole clamps and the antenna attached thereto. Threaded bolt 124 is then rotated by the installer to move bracket 130 linearly along the bolt in either of directions 135, which correspondingly moves the pole clamps around the pole, until the maximum signal strength of the antenna is achieved. Locking nuts 54 are then tightened on fasteners 20 and 21 to secure the pole clamps in the fine, adjusted azimuth position.

As will be understood by those skilled in the art, during this fine tuning operation bracket 130 may pivot slightly about clevis 128 and bolt 124 and clevis 122 may pivot slightly about axis 120. Bracket 130 is manufactured in a size and shape such that the bracket may pivot approximately 30 degrees in either direction before the bracket contacts threaded bolt 124. Angular movement of less than 30 degrees in either direction typically is required for fine tuning operations of the azimuth angle of the antenna. If larger angles are required, the installer typically may fasten the pole clamps to pole 18, loosen the installation tool, rotate the installation tool about the pole, refasten the installation tool to the pole, loosen and then rotate the pole clamps about the pole in a rough adjustment, and then fine tune the position of the pole clamps using adjustment tool 38 as described above. Such an iterative process is a relatively simple task due to the support provided to the antenna by the installation tool during repositioning of the antenna around the pole. Once the azimuth angle is finely tuned, the installer may finely tune the elevation position of the antenna.

Figure 12:
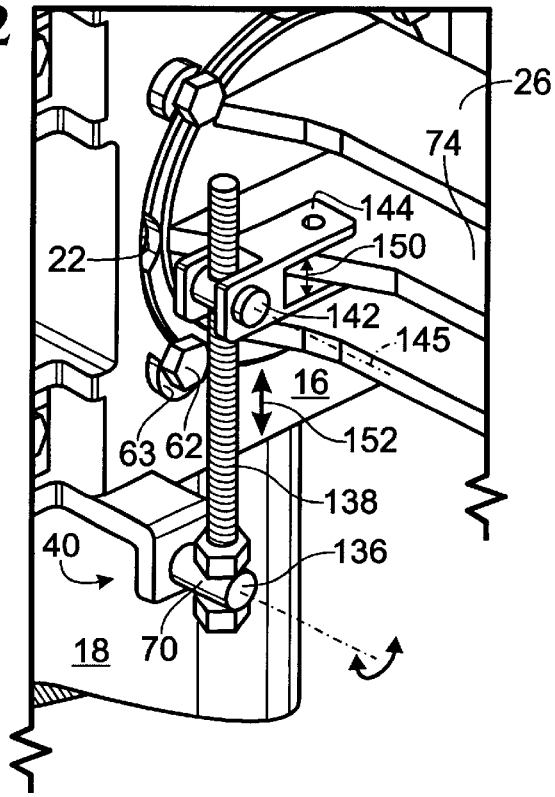
FIG. 12 is a detailed isometric view of the second adjustment tool secured to the front plate of the pole clamp.

FIG. 12 is a detailed isometric view of the second adjustment tool secured to the front plate of the pole clamp. To adjust the elevation angle of the antenna, throughhole clevis 136 is secured within aperture 70 of front pole clamp plate 16. This operation may also be completed prior to mounting of the assembly on pole 18. Threaded bolt 138 is rotated until "C" shaped bracket 144 is aligned with the central one of support braces 74 whereupon the support brace is positioned to receive an edge of the support brace within "C" shaped width 150 of bracket 144. Bolts 62 are then slightly loosened such that the base may rotate with respect to interface plate 22 but such that bolts 62 and pin 59 secure the antenna support structure on the interface plate. The associated transceiver, which may already by turned on, is then used to measure the signal strength of the antenna. Threaded bolt 138 is then rotated to move bracket 144 linearly along the bolt in either of directions 152, which correspondingly moves the support structure about the shear pin, until the maximum signal strength of the antenna is achieved. Bolts 62 are then tightened against raised surface 63 to secure the antenna base in place.

As will be understood by those skilled in the art, during this fine tuning operation bracket 144 may pivot slightly about axis 145 of clevis 142 and bolt 138 and clevis 136 may pivot slightly about axis 73. Bracket 144 is manufactured in a size and shape such that the bracket may pivot approximately 30 degrees in either direction before the bracket 144 contacts threaded bolt 138. Angular movement of less than 30 degrees in either direction typically is required for fine tuning operations of the elevation angle of the antenna. If larger angles are required, the installer typically will remove bracket 144 from the central support brace, rotate base 24 to an angle approximating the correct elevation angle, and then position bracket 144 on one of the other support braces 74 of support structure 26. Such an iterative process is a relatively simple task due to the support provided to the antenna by bolts 62 and pin 59.

Figure 13:
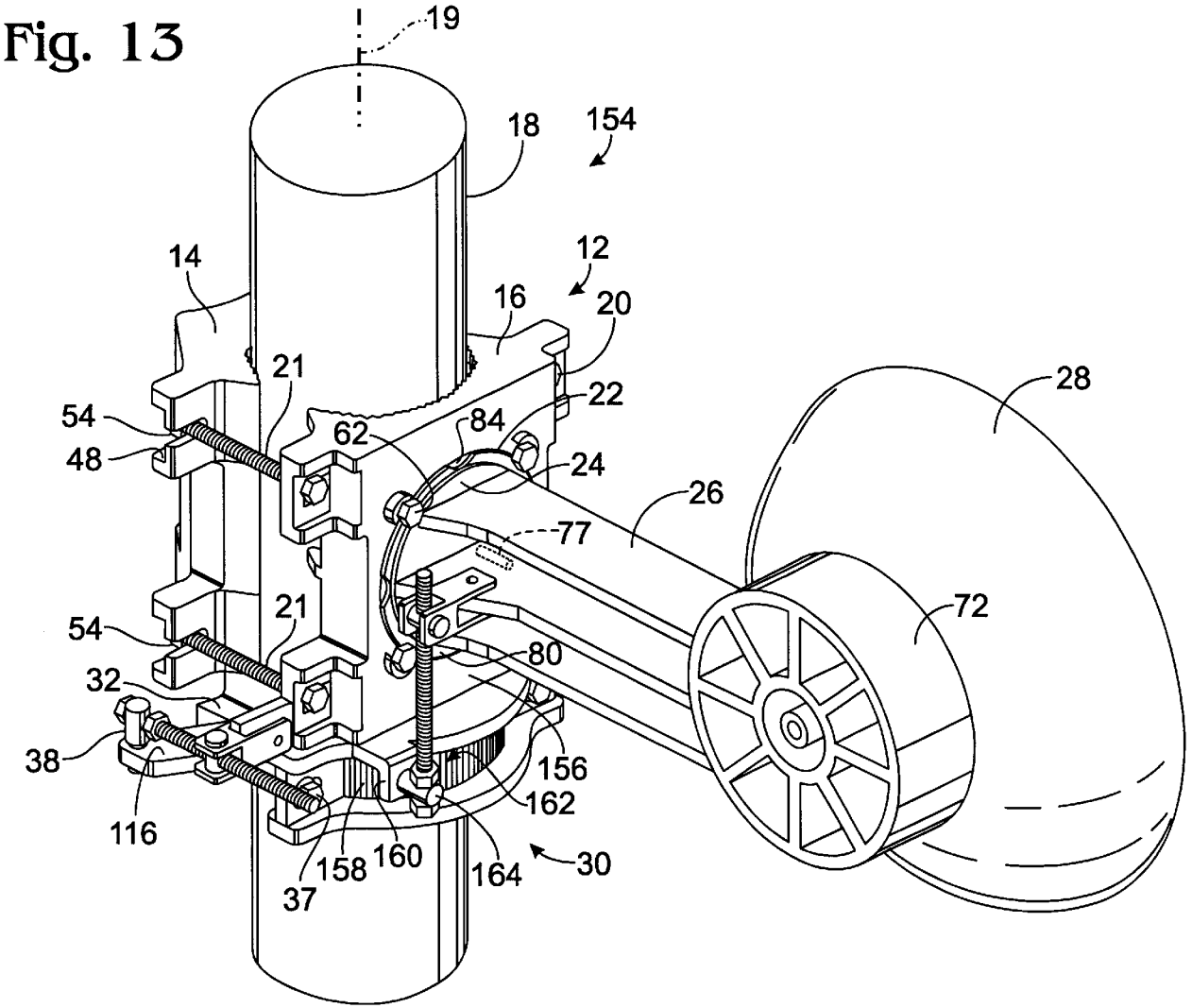
FIG. 13 is an isometric view of another embodiment of the antenna mounting assembly including an installation tool used to adjust both the azimuth and the elevation angle of an antenna secured to a set of pole clamps.

FIG. 13 shows an isometric view of another embodiment of the invention wherein the installation tool has mounted thereon both the azimuth and the elevation adjustment tools. Antenna mounting assembly 154 includes a front pole clamp plate 156 and a front tool clamp plate 158. Front pole clamp plate 156 does not include a mounting flange for securing an adjustment tool thereto. Instead, front tool clamp plate 158 includes a mounting flange 160 having an aperture 162 extending therethrough. An adjustment tool 164 is secured within aperture 162 such that the tool may be used to adjust the elevation angle of antenna support structure 26.

Figure 14:
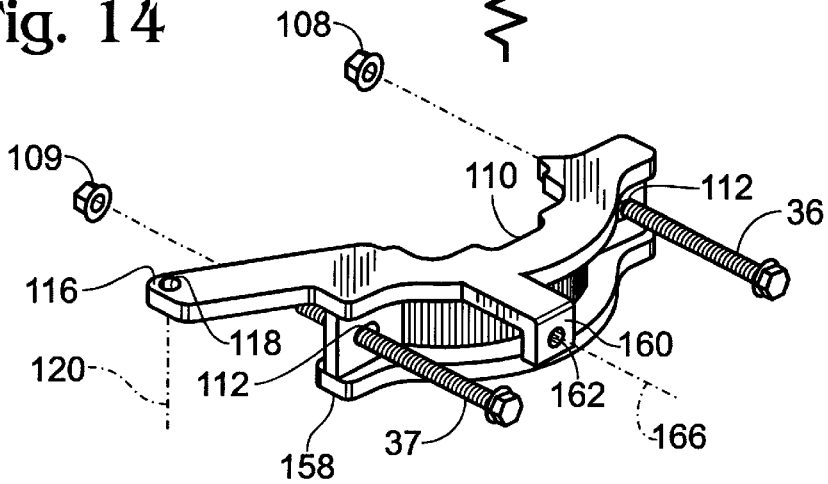
FIG. 14 is a detailed view of the front tool clamp plate of the installation tool shown in FIG. 13.

FIG. 14 shows front tool clamp plate 158 including mounting flange 160 having aperture 162 extending therethrough. Aperture 162 defines an axis 166 aligned generally with an elongate axis of fasteners 36 and 37 and generally perpendicular to the axis of pole 18 (not shown) and axis 120 of aperture 118. Flange 160 may be positioned at other locations on the front or rear tool clamp plates. Flange 160 preferably is spaced a distance from mounting flange 116 so that adjustment tools mounted on each of the flanges will not interfere with one another during installation of an antenna on a pole.

Figure 15:
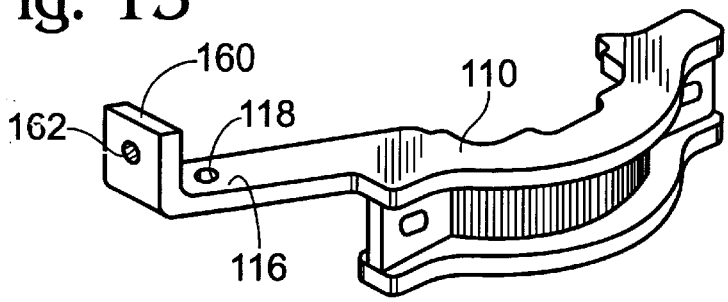
FIG. 15 is a detailed view of another embodiment of the front tool clamp plate.

FIG. 15 shows another embodiment, wherein flange 160 extends upwardly from flange 116 such that both adjustment tools are mounted on the single flange during use of each adjustment tool. In such an embodiment, a single adjustment assembly may be moved sequentially between apertures 118 and 162 in the flange during fine adjustment of the azimuth and elevation angles of the antenna, such that only one adjustment assembly is required.

Figure 16:
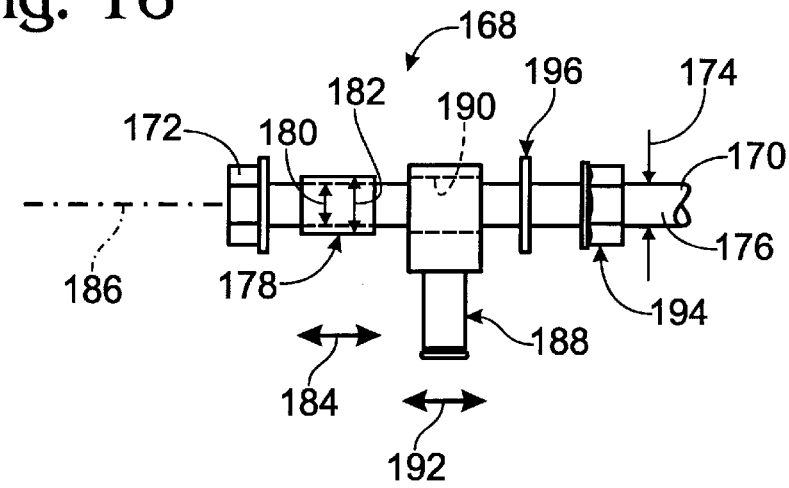
FIG. 16 is a side view of an adjustment tool assembly which allows two-directional adjustment of an antenna.

FIG. 16 is a side view of an adjustment tool that allows two directional adjustment of an antenna. Adjustment tool 168 includes a threaded bolt 170 having a bolt head 172 and an outer diameter 174 of a threaded region 176. A spacer 178 is positioned on threaded region 176 and includes an inner diameter 180 that is greater than outer diameter 174 of bolt 170. Accordingly, spacer 178 is free to rotate about and move along threaded region 176. Spacer 178 further comprises an outer diameter 182, and a length 184 extending parallel to an elongate axis 186 of bolt 170. A clevis 188 includes an aperture 190 sized to receive spacer 178 wherein the inner diameter of aperture 190 is only slightly larger than outer diameter 182 of the spacer. When the spacer is positioned within aperture 190, therefore, side to side movement of the bolt within the clevis is minimized. Clevis 188 further includes a width 192 slightly less than length 184 of spacer 178 such that when the spacer is centered within aperture 190, the spacer extends outwardly from the clevis only a very short distance on either side of the clevis. Tool 168 further comprises a nut 194 and a washer 196 mounted on threaded region 176 of the bolt. Washer 196 has an inner diameter greater than the outer diameter of threaded region 176 so that the washer moves freely along the bolt. Nut 194 includes internal threads that mate with the threads of bolt 170 such that the nut may be tightened on the bolt toward bolt head 172.

Figure 17:
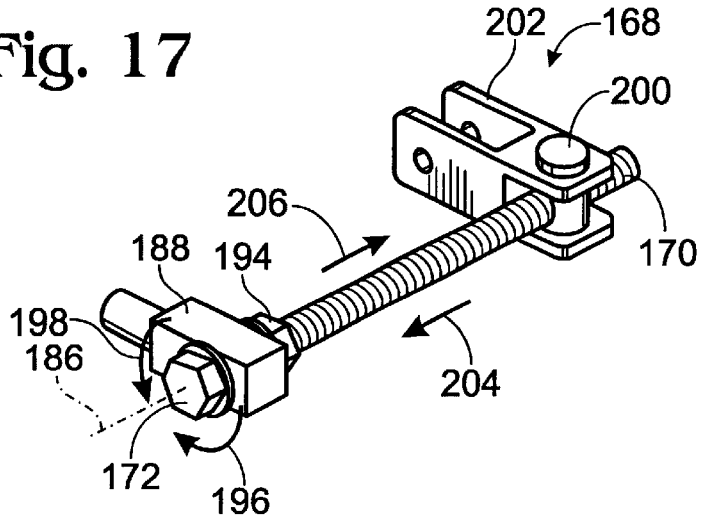
FIG. 17 is an isometric view of the adjustment tool of FIG. 15.

FIG. 17 is an isometric view of installation tool 168 showing nut 194 fully tightened toward bolt head 172. Due to the length of spacer 178, which is slightly longer than the length of clevis 188 at aperture 190, bolt 170 is free to rotate within clevis 188 such that bolt 170 and nut 194 may be forced to rotate in either of directions 196 and 198 about axis 186 while clevis 188 remains stationarily secured to a mounting flange as described above. In other words, nut 194 may be completely tightened on bolt 170 without interfering with rotation of the bolt within clevis 188. Adjustment tool 168 further comprises a threaded clevis 200 and a "C" shaped bracket 202 similar to the devices described with respect to FIGS. 9 and 10. Accordingly, with clevis 188 secured within a mounting flange and bracket 202 secured to either the antenna support structure or the pole clamp plate, as threaded bolt 170 is rotated in direction 196, threaded clevis 200 and bracket 202 are moved linearly along bolt 170 in a direction 204. As threaded bolt 170 is rotated in direction 198, threaded clevis 200 and bracket 202 are moved linearly along bolt 170 in a direction 206. Due to the length of spacer 178 which is only slightly longer than aperture 190 of clevis 188, there is little "backlash" of bolt 170 when the direction of rotation of the bolt is changed. In other words, adjustment tool 168 allows both forward and rearward movement of bracket 202 linearly along bolt 170, which allows for fine adjustment of the azimuth and elevation angle of the antenna, while minimizing the slop and play of the device as adjustments are made between the forward and rearward direction of the bracket. As will be understood by those skilled in the art, adjustment tool 168 can be used on any of the mounting flanges thus described to adjust either the azimuth or the elevation angles of the antenna.

In the preferred embodiment, all the fastening devices are manufactured such that they may be tightened with the same tool. The tool may comprise an open ended wrench, a cross or flat head screw driver, or any other adjustment device known in the art. Accordingly, a single fastening tool is required to be carried by the installer which simplifies the installation procedure. In addition, the sequence of azimuth and elevation fine-tuning may be reversed, as will be understood by those skilled in the art.

In another orientation, pole 18 may be positioned parallel with respect to the horizon such that the first adjustment tool is used to adjust the elevation angle of the antenna and such that the second adjustment tool is used to adjust the azimuth angle of the antenna. In another orientation, pole 18 may be positioned at an acute angle with respect to the horizon such that the first and the second adjustment tools may be used in cooperation to adjust both the azimuth and the elevation angle of the antenna. In the case of a pole having a non-circular cross section, inserts may be provided which have an internal surface that conforms to the outer shape of the pole whereby the inserts have a circular external shape such that the pole clamps and the tool clamps may be secured therearound.

In the above description numerous details have been set forth in order to provide a more through understanding of the present invention. It will be obvious, however, to one skilled in the art that the present invention may be practiced using other equivalent designs.

I claim:

1. An antenna mounting assembly comprising:

a first pole clamp with a first pole receiving channel attachable to a pole;

a support for supporting an antenna relative to the first pole clamp and being movable relative to the first pole clamp;

a lock assembly for selectively securing the support to the first pole clamp;

a second pole clamp with a second pole receiving channel attachable to the pole;

a first adjustment assembly coupling the second pole clamp to the first pole clamp and operable for moving the first pole clamp relative to the second pole clamp; and a second adjustment assembly coupling the second pole clamp to the support and operable for moving the support relative to the first pole clamp.

2. The antenna mounting assembly of claim 1 wherein the first pole receiving channel defines a circumference and wherein the first adjustment assembly is operable for moving the first pole clamp circumferentially with respect to the first pole receiving channel.

3. The antenna mounting assembly of claim 1 wherein the first adjustment assembly is operable for moving the first pole clamp relative to the second pole clamp when the first pole clamp is not fixedly attached to the pole.

4. The antenna mounting assembly of claim 1 wherein the first adjustment assembly is adapted for removal from the pole after the first pole clamp is fixedly attached to the pole.

5. The antenna mounting assembly of claim 1 wherein the first pole clamp defines a rotational axis and wherein the second adjustment assembly is operable for rotating the support about said rotational axis.

6. The antenna mounting assembly of claim 5 wherein the second adjustment assembly is operable for rotating the support in first and second opposite directions about said rotational axis.

7. The antenna mounting assembly of claim 1 wherein the second adjustment assembly comprises a threaded bolt positioned within a clevis.

8. An installation tool comprising a first tool clamp plate including a mounting flange and a first pole receiving channel attachable to a pole having an elongate pole axis;

a second tool clamp plate including a second pole receiving channel attachable to the pole, said second tool clamp plate operable for engagement with said first tool clamp plate to secure the first and second tool clamp plates to the pole within said first and second pole receiving channels; and an adjustment assembly mounted on said mounting flange and having a support contact element adapted for attachment to an antenna support separately mounted on the pole wherein said adjustment assembly is operable for moving said support contact element relative to said mounting flange thereby pivoting the antenna support relative to the first and second tool clamp plates about a pivot axis unaligned with said elongate pole axis when the tool clamp plates are secured to the pole.

9. The installation tool of claim 8 wherein said support contact element comprises a bracket for releasably attaching said installation tool to the antenna support.

10. The installation tool of claim 8 wherein said adjustment assembly is adapted for capturing a support brace of an antenna support.

11. The installation tool of claim 8 wherein said adjustment assembly is operable for pivoting said antenna support in first and second opposite directions about said pivot axis.

12. The installation tool of claim 8 wherein said installation tool is operable for removal from the pole once the antenna support is secured to the pole.

13. An antenna mounting assembly comprising:

a pole clamp operable for attachment to a pole;

an antenna support structure movably secured to said pole clamp and adapted for supporting an antenna thereon; and an installation tool including a tool clamp operable for releasable attachment to a pole and first and second adjustment mechanisms positioned on said tool clamp, said first adjustment mechanism releasably coupling the installation tool to the pole clamp and being operable to adjust a position of the pole clamp relative to the installation tool when the installation tool is secured to the pole and said second adjustment mechanism releasably coupling the installation tool to the antenna support structure and being operable to adjust a position of the antenna support structure relative to the installation tool.

14. The antenna mounting assembly of claim 13 wherein said first and second adjustment mechanisms each comprise a clevis with a bolt extending therethrough.

15. The antenna mounting assembly of claim 13 wherein said first adjustment mechanism is operable for moving the pole clamp in first and second opposite directions relative to the installation tool.

16. The antenna mounting assembly of claim 13 wherein said second adjustment mechanism is operable for moving the antenna support in first and second opposite directions relative to the installation tool.

17. An antenna mounting assembly comprising:

a pole clamp operable for attachment to a pole;

an antenna operably connected to said pole clamp; and an installation tool including an adjustment mechanism operable for moving said antenna with respect to said installation tool, wherein said adjustment mechanism comprises a threaded bolt, a spacer and a fastener both positioned on said bolt, and a clevis having an aperture sized to receive said spacer therein such that said fastener is adapted to be tightened on said bolt without hindering rotation of said bolt within said clevis.

18. The antenna mounting assembly of claim 17 wherein said adjustment mechanism is operable for moving the pole clamp in first and second opposite directions relative to the installation tool.

19. The antenna mounting assembly of claim 17 wherein said adjustment mechanism is operable for moving the antenna in first and second opposite directions relative to the pole clamp.

* * * * *